United States Patent [19]

Taylor

[11] Patent Number: 4,588,317

[45] Date of Patent: May 13, 1986

[54] LEAD OR PEN MARKING DEVICE

[76] Inventor: Clarence R. Taylor, 28 Woodside Dr., Penfield, N.Y. 14526

[21] Appl. No.: 657,898

[22] Filed: Oct. 5, 1984

[51] Int. Cl.[4] ..... B43K 19/00; B43K 23/00; B43K 25/00

[52] U.S. Cl. ..... 401/131; 24/11 R; 24/11 F; 401/6; 401/7; 401/117

[58] Field of Search ..... 401/6, 117, 131, 7; 24/11 R, 11 F

[56] References Cited

U.S. PATENT DOCUMENTS

| | | | |
|---|---|---|---|
| 825,985 | 7/1906 | Schwertenberg | 401/6 |
| 1,486,294 | 3/1924 | Morris | 401/195 X |
| 1,598,873 | 9/1926 | Peterson | 401/6 |
| 1,607,894 | 11/1926 | Johnson | 24/11 F |
| 2,288,878 | 7/1942 | Baer | 24/11 F |
| 2,298,247 | 10/1942 | Sampson | 24/11 F |
| 3,092,244 | 6/1963 | McWhirter | 401/195 X |
| 3,168,072 | 2/1965 | Nitta | 401/6 X |
| 3,887,286 | 6/1975 | Bucey | 401/7 |
| 4,167,347 | 9/1979 | Hoyle | 401/6 X |

FOREIGN PATENT DOCUMENTS

| | | | |
|---|---|---|---|
| 99094 | 1/1984 | European Pat. Off. | 401/104 |
| 2431377 | 2/1980 | France | 401/6 |
| 1521178 | 8/1978 | United Kingdom | 401/131 |

*Primary Examiner*—Steven A. Bratlie

[57] ABSTRACT

A lead or pen marking device comprising a body member having a substantially flat finger gripping plate at one end, and a lead or pen marking tip at the other end.

7 Claims, 13 Drawing Figures

LEAD OR PEN MARKING DEVICE

FIELD OF THE INVENTION

This invention relates generally to the field of marking, and more particularly to a marking device for placing a mark, such as a numeral or name, on a sheet or the like.

DESCRIPTION OF THE PRIOR ART

It is known in the art to provide short, sharpened, erasureless lead pencils to game players, such as golf players, for example, to enable them to mark scores on a score pad. Problems with lead pencils of this type are that they are cumbersome, unwieldly and easily lost, among other things.

SUMMARY OF THE INVENTION

In accordance with a preferred embodiment of the invention, a lead or pen marking device is disclosed having a preferably plastic body member. The body member has a substantially flat finger gripping plate at one end thereof, and holding means at the opposite end thereof for holding a marking tip, such as a lead, pen, or eraser.

In a more specific embodiment of the invention, the finger gripping plate has an arcuate cross-section, and securing means are provided on the plate for releasably securing the marking device to a support member.

In a more specific embodiment of the invention, the securing means on the plate comprises a spring finger, and the plate further has projections on at least one outer surface thereof. The holding means comprises a stud having a bore for receiving one end of a lead, pen, or eraser.

The primary advantages of the marking device of this invention are that it is inexpensive, may readily be attached to a shirt pocket, for example, or worn around ones neck or the like so that it is not easily lost, may have advertising material imprinted thereon, may serve as a book mark, and may be easily handled and used.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 1:
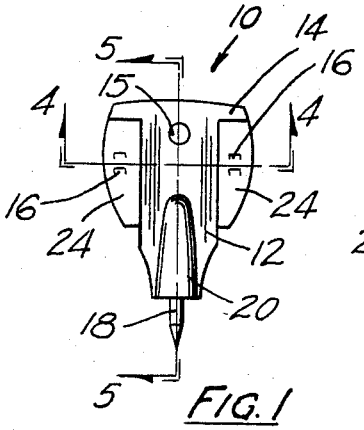
FIG. 1 is a front elevational view of a preferred embodiment of the marking device of this invention.
Figure 2:
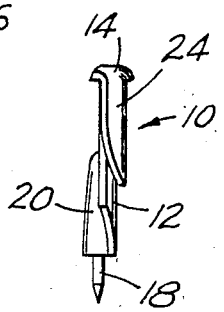
FIG. 2 is a side elevational view of the marking device of FIG. 1.

Referring now to FIGS. 1–5 of the drawings, a preferred embodiment of the marking device 10 of this invention comprises a unitary body member 12 preferably formed of plastic material by any suitable molding operation. The body member 12 has a finger gripping plate 14 at one end thereof of arcuate cross-section having a roughened front surface in the form of a projection 16 or the like to increase the frictional gripping force on the plate. Plate 14 further may have an opening 15 therethrough for receiving an endless string or the like, not shown, by which the marking device could be attached to one's neck or wrist.

Holding means are provided at the opposite end of body member 12 for holding a sharpened lead marking tip 18. The holding means comprises a semi-cylindrical boss 20 having a blind bore 22 into which the lead 18 is slid and retained therein by friction. To facilitate insertion of the lead, the boss 20 preferably has elongated sharp sided ribs 23 to more readily accommodate leads of slightly varying diameter. When the marking tip 18 is worn out, broken or lost in use it can be replaced by a new marking tip removed from any suitable marking tip holding container, not shown.

The marking device 10 is further provided with securing means for releasably securing the marking device to any suitable support member, such as a shirt pocket, a golf scoring card or a book sheet, for examples, not shown. The securing means comprises a pair of spring fingers 24 substantially parallel to and spaced from plate 14, and extending along each side thereof. One end of each finger 24 is preferably integral with the free end of plate 14, and the opposite end of the finger is free.

Figure 6:
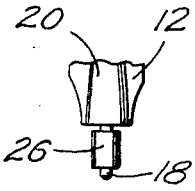
FIG. 6 is a segmental view of a pen marking tip of a marking device showing the pen end exposed.
Figure 7:
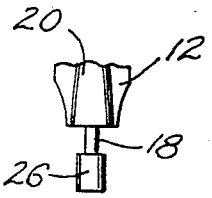
FIG. 7 is a view similar to FIG. 6 showing the pen end covered.
Figure 3:
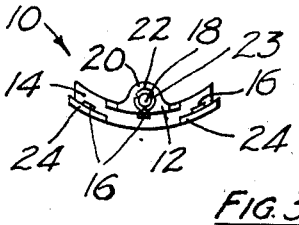
FIG. 3 is a bottom end view of the marking device of FIG. 1.
Figure 4:
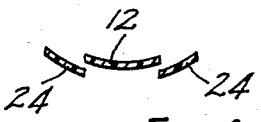
FIG. 4 is a section view taken substantially along line 4—4 of FIG. 1.

With reference to FIGS. 6 and 7, a pen marking tip 18 of the ball point type is disclosed inserted within bore 22. The pen tip 18 is provided with a sleeve 26 slidably mounted thereon between a retracted position as seen in FIG. 6 in which the pen end is exposed for marking an object, such as a score card, and an extended position as seen in FIG. 7 in which the pen end is covered to prevent inadvertent marking of an object by the pen.

Figure 8:
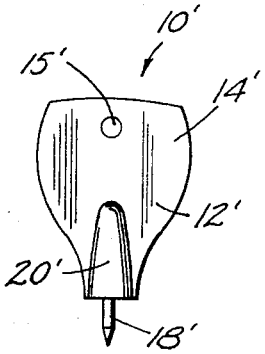
FIG. 8 is a front elevational view of another embodiment of the marking device of this invention.
Figure 9:
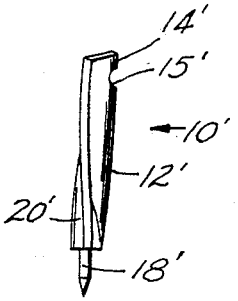
FIG. 9 is a side elevational view of the marking device of FIG. 8.
Figure 5:
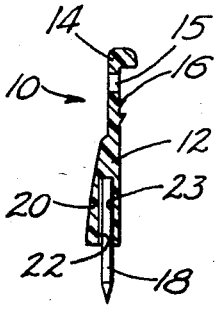
FIG. 5 is a section view taken substantially along line 5—5 of FIG. 1.
Figure 10:
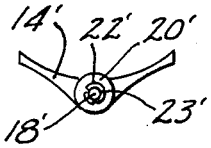
FIG. 10 is a bottom end view of the marking device of FIG. 8.

With reference to FIGS. 8–10, another embodiment of the marking device 10 is disclosed in which parts similar to parts shown in FIGS. 1–5 are denoted by the same numerals primed. In this embodiment, the spring fingers 24 and roughened surface 16 are omitted.

Figure 11:
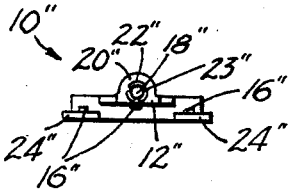
FIG. 11 is a bottom end view of still another embodiment of the marking device of this invention.

With reference to FIG. 11, still another embodiment of the marking device 10 is disclosed in which parts similar to parts shown in FIGS. 1–5 are denoted by the same numerals double primed. In this embodiment, the finger gripping plate 14″ is flat.

Figure 12:
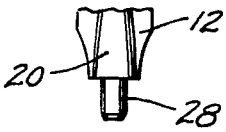
FIG. 12 is a segmental view of the lower end of a marking device holding an eraser.

With reference to FIG. 12, the lower end of the marking device of FIG. 1 is shown in which a cylindrical eraser 28 is inserted in boss 20 to allow erasure of unsuitable markings.

Figure 13:
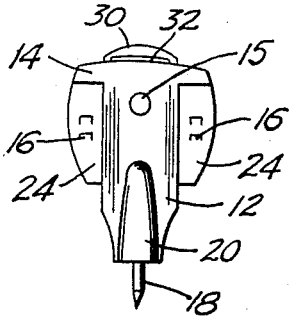
FIG. 13 is a front elevational view of another embodiment of the invention showing an eraser secured to the upper end of the marking device.

With reference to FIG. 13, another embodiment of the invention of FIG. 1 is shown in which a narrow, elongated, arcuate eraser 30 is secured into a receptacle, molded into the upper end surface of the marking device 10, by any suitable means 32 such as a spring or adhesive.

In all embodiments of the marking device 10, the outer surface of plate 14 is preferably smooth for receiving advertising or promotional information in printed or label form, such as the name of a company, a bank, a golf course, or the like.

While preferred embodiments of the invention have been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

I claim:

1. A one-piece throw-away marking device moldable from a plastic material comprising:

a straight longitudinally extending plate-like finger gripping body member having front and rear surfaces and parallel spaced apart side edges;

a longitudinally extending boss on said body member at one end thereof having a longitudinally extending blind bore for slidably receiving one end of a lead or pen; and a pair of elongated spaced apart spring fingers spaced from and substantially parallel to said body member and extending parallel to and laterally outwardly of said side edges for releasably securing the marking device to a support member, each of said spring fingers having one free end and the opposite end thereof integral with the opposite end of said body member.

2. A marking device according to claim 1 wherein said body member and said spring fingers are of arcuate cross-section.

3. A marking device according to claim 1 wherein said body member and said fingers have laterally extending projections facing one another.

4. A marking device according to claim 1 wherein said body member has an opening extending therethrough at the opposite end thereof for receiving an endless string or the like.

5. A marking device according to claim 1, and further comprising a sleeve slidably mounted on said lead or pen for covering and exposing said lead or pen.

6. A marking device according to claim 1 wherein said rear surface is smooth, and said boss laterally extends from said front surface.

7. A marking device according to claim 1 wherein said body member and said spring fingers are of arcuate cross-section, said body member and said spring fingers have laterally extending projections facing one another, said body member has an opening extending therethrough at the opposite end thereof for receiving an endless string or the like, said marking device further comprises a sleeve slidably mounted on said lead or pen for covering and exposing said lead or pen, and said rear surface of said body member is smooth and said both laterally extends from said front surface.

* * * * *